United States Patent [19]

Pyle

[11] 4,213,488

[45] Jul. 22, 1980

[54] VALVE MEANS RESPONSIVE TO THE OPERATION OF A VAPOR-SEAL VALVE FOR PREVENTING FUEL SPILLAGE FROM THE DISCHARGE SPOUT OF A VAPOR-RECOVERY FUEL DISPENSING NOZZLE

[75] Inventor: Walter R. Pyle, Richmond, Calif.

[73] Assignee: Chevron Research Company, San Francisco, Calif.

[21] Appl. No.: 965,967

[22] Filed: Dec. 4, 1978

[51] Int. Cl.[3] ..... B65B 3/18

[52] U.S. Cl. ..... 141/1; 141/46; 141/207; 141/208; 141/293; 141/302

[58] Field of Search ..... 141/1, 46, 52, 59, 198, 141/206–229, 287, 290, 291–294, 301, 302, 305, 392

[56] References Cited

U.S. PATENT DOCUMENTS

| | | | |
|---|---|---|---|
| 3,982,571 | 9/1976 | Fenton et al. | 141/292 |
| 4,058,149 | 11/1977 | Hansel | 141/301 |
| 4,060,108 | 11/1977 | Weston et al. | 141/59 |
| 4,060,110 | 11/1977 | Bower | 141/207 |
| 4,143,689 | 3/1979 | Conley et al. | 141/207 |

FOREIGN PATENT DOCUMENTS

| | | | |
|---|---|---|---|
| 931,756 | 7/1955 | Fed. Rep. of Germany | 141/392 |

*Primary Examiner*—Frederick R. Schmidt

*Attorney, Agent, or Firm*—R. L. Freeland, Jr.; William J. Egan, III

[57] ABSTRACT

A valve means for a fuel dispensing nozzle located in the nozzle discharge spout at the outlet end thereof for sealing the outlet end to prevent the flow of fuel and fuel vapors out of the discharge spout when the nozzle vapor-seal valve is closed. The valve means is responsive to the operation of the vapor-seal valve so that when the vapor-seal valve is closed when the nozzle is not in use, the valve means is closed and so that when the vapor-seal valve is open when the discharge spout is operatively inserted into a fill pipe of a fuel tank, the valve means is open. To this purpose, means are provided to establish communication between the valve means and the flow passage upstream of the nozzle flow control valve and between the valve means and the flow passage in the discharge spout. In one embodiment, the valve means located in the discharge spout at the outlet end thereof is a pinch valve, and in another embodiment, the valve means is a wafer valve. In each embodiment, the valves are operable by the fuel pressure available in the nozzle.

8 Claims, 7 Drawing Figures

VALVE MEANS RESPONSIVE TO THE OPERATION OF A VAPOR-SEAL VALVE FOR PREVENTING FUEL SPILLAGE FROM THE DISCHARGE SPOUT OF A VAPOR-RECOVERY FUEL DISPENSING NOZZLE

FIELD OF THE INVENTION

The present invention relates to vapor-recovery fuel dispensing nozzles for dispensing fuel into vehicle fuel tanks, and more particularly, to a valve means which is used for sealing the outlet end of a discharge spout of a vapor-recovery fuel dispensing nozzle to prevent the flow of fuel and fuel vapors therethrough.

BACKGROUND OF THE INVENTION

In an attempt to reduce hydrocarbon emissions, environmental regulations in certain areas of the country require that gasoline vapors displaced from vehicle fuel tanks during refueling are to be recovered to prevent their escape into the atmosphere. Accordingly, nozzle assemblies incorporating vapor recovery systems have been designed to comply with these regulations. As is known in the art, many of these nozzles have a vapor-recovery system for receiving the vapors displaced from the fuel tank and storing them in a service station's underground hydrocarbon storage tank. These nozzles normally include a discharge spout that extends into the mouth of the fill pipe of the fuel tank and a vapor-recovery shroud that fits in sealing engagement with the mouth of the fill pipe during refueling so as to receive the vapors displaced from the fuel tank. With this arrangement, vapors in the fuel tank are displaced from the tank as fuel is pumped into the tank. The displaced vapors will then flow by way of the shroud into a vapor-recovery passage in the nozzle and from there by appropriate means to the hydrocarbon storage tank.

A problem that commonly arises in the use of vapor-recovery nozzles is the occurrence of fuel spills from the discharge spout of the nozzle. When the nozzle is shut off at the termination of vehicle refueling, some fuel usually remains in the discharge spout of the nozzle, and upon removal of the nozzle from the fill pipe, the fuel remaining in the discharge spout may spill from the spout, striking the vehicle, the operator of the nozzle or the ground. Any fuel that does not spill from the spout may evaporate in the spout when the nozzle is not in use and stored in the fuel dispenser. When fuel spillage occurs either by fuel spilling from the discharge spout or by fuel vapors escaping therefrom, hydrocarbon emissions will be produced, offsetting the gain made towards the recovery of escaping fuel vapors by the use of vapor-recovery nozzles.

Vapor-recovery fuel dispensing nozzles that are currently available, such as those described in U.S. Pat. Nos. 4,060,110 (Bower) and 4,058,149 (Hansel) are not designed to eliminate the heretofore-described problem. Accordingly, the present invention is directed to a valve means for sealing the outlet end of a discharge spout of a vapor-recovery fuel dispensing nozzle so that fuel and fuel vapors remaining in the discharge spout subsequent to refueling are prevented from escaping therefrom.

SUMMARY OF THE INVENTION

In accordance with the present invention, a valve means for a vapor-recovery fuel dispensing nozzle is provided wherein the valve means is located in the nozzle discharge spout at the outlet end thereof for sealing the outlet end to prevent the flow of fuel and fuel vapors therethrough when the nozzle vapor-seal valve is closed. When the vapor-seal valve is open, the valve means is open to permit the flow of fuel out of the discharge spout. Fuel dumping means are provided for establishing communication between the valve means and the nozzle vapor-seal valve so that the valve means is responsive to the operation of the nozzle vapor-seal valve to be in an open position when the vapor-seal valve is open. Fuel supply means are also provided so that a fuel pressure is supplied to the valve means to close the valve means to seal the outlet end of the discharge spout.

The valve means of the present invention is preferably either a pinch valve or a wafer valve, both of which are operable by the fuel pressure available in the nozzle. The fuel supply means of the present invention includes a fluid passageway connected between the flow passage upstream of the flow control valve and the valve means for flowing fuel to the valve means to provide a fluid pressure of approximately 30 psi to the valve means to close the valve means when the nozzle is not in use and the vapor-seal valve is closed. The fuel dumping means includes a piston-cylinder assembly that is located on the discharge spout in proximate relation to the vapor-seal valve and connected thereto so that when the vapor-seal is open when the discharge spout is inserted into a fuel tank fill pipe, the valve means is open. The fuel dumping means establishes fluid communication between the fluid passageway connected to the valve means, in which fuel flows at a pressure of approximately 30 psi, and the flow passage in the discharge spout, which is at atmospheric pressure, so that the fuel will flow from the valve means to the flow passage in the discharge spout in order to open the valve means. When the nozzle is not in use, the vapor-seal valve is closed and fuel flows from the flow passage upstream of the flow control valve through the fuel supply means to the valve means to provide the necessary fluid pressure to close the valve means, thereby sealing the outlet end of the discharge spout.

PRINCIPAL OBJECT OF THE INVENTION

A particular object of the present invention is to provide a valve means responsive to the operation of the nozzle vapor-seal valve wherein the valve means is located in the nozzle discharge spout at the outlet end thereof for sealing the outlet end of the discharge spout to prevent the flow of fuel and fuel vapors therethrough when the nozzle vapor-seal valve is closed, the valve means being opened to open the outlet end of the discharge spout when the vapor-seal is open.

Additional objects and advantages of the invention will become apparent from a detailed reading of the specification and drawings which are incorporated herein and made a part of this specification.

DESCRIPTION OF THE PREFERRED EMBODIMENT

For illustrative purposes, the present invention is described with respect to a vapor-recovery fuel dispensing nozzle of the type shown in U.S. Pat. No. 4,060,110. It is noted, however, that this invention may be used with most other types of vapor-recovery dispensing nozzles.

Figures 1, 2A, 2B:
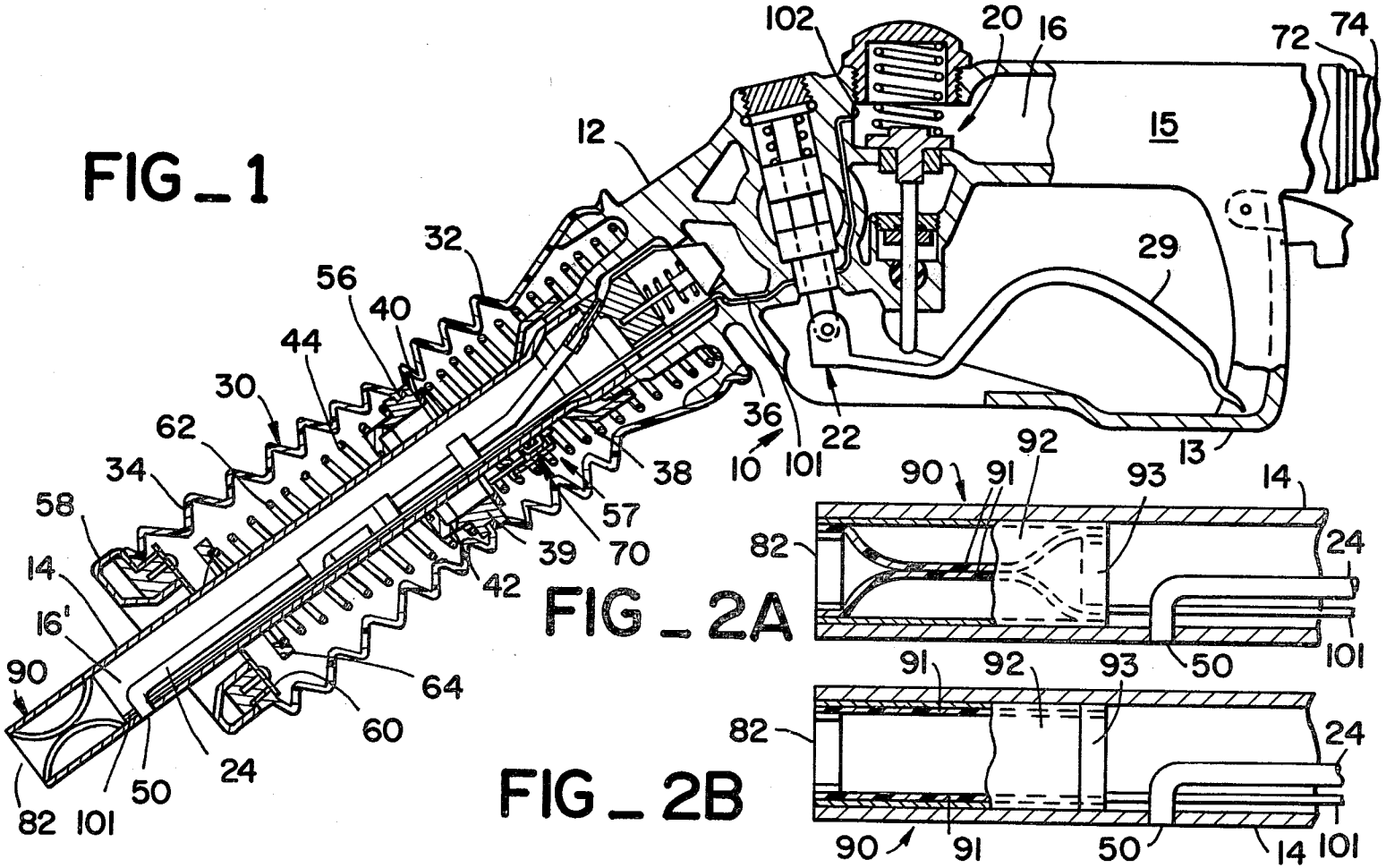
FIG. 1 is a longitudinal sectional view of a vapor-recovery fuel dispensing nozzle according to an embodiment of the present invention.
FIG. 2A is an enlarged fragmentary view illustrating the pinch valve of FIG. 1 in a closed position.
FIG. 2B is a view illustrating the pinch valve of FIG. 2A in an open position.

Referring now to the drawings, FIG. 1 represents a vapor-recovery dispensing nozzle 10 having a main body portion 12 with an open-end discharge spout 14 projecting from the nozzle main body portion for insertion into a fill pipe, not illustrated, of a vehicle fuel tank. The discharge spout has an outlet end 82 proportioned for ease of insertion into the fill pipe of the fuel tank. A liquid flow passage, indicated by reference numerals 16 and 16', extends through the main body portion 12 and the discharge spout 14. That part of the liquid flow passage extending through the main body portion 12 and which is referred to as numeral 16 is in communication at one end thereof with that part of the liquid flow passage, referred to as numeral 16', in the discharge spout 14. The other end of flow passage 16 is in communication with a fuel hose 72 which is connected between the nozzle 10 and a fuel dispenser, which is not illustrated.

A flow control valve, indicated generally by the reference numeral 20, is located in the flow passage 16 for opening and closing the passage to regulate the flow of fuel through the passage. Flow control valve 20 may be operated to flow fuel through flow passage 16 and thus through flow passage 16' in the discharge spout by squeezing lever 29 of the releasable latching mechanism, identified generally by numeral 22, in the direction toward handle 15. A guard 13 may be provided to protect lever 29 as well as to provide a support for holding the nozzle when it is stored in the fuel dispenser when not in use.

The nozzle may also have a vacuum-operated release mechanism for automatically closing flow control valve 20 when the level of fuel in the tank being filled reaches the end of the discharge spout. To this purpose, and as is well known in the art, a vent tube 24 extends through the discharge spout 14 and has an opening or port 50 through the lower surface of the discharge spout near the outlet end 82 thereof. Releasable latching mechanism 22 is automatically operated to close the valve 20 when normal venting of the vacuum mechanism by way of vent tube 24 is interrupted, which occurs when the level of fuel in the tank being filled rises to a level sufficient to close the vent passage opening 50.

Figure 3A:
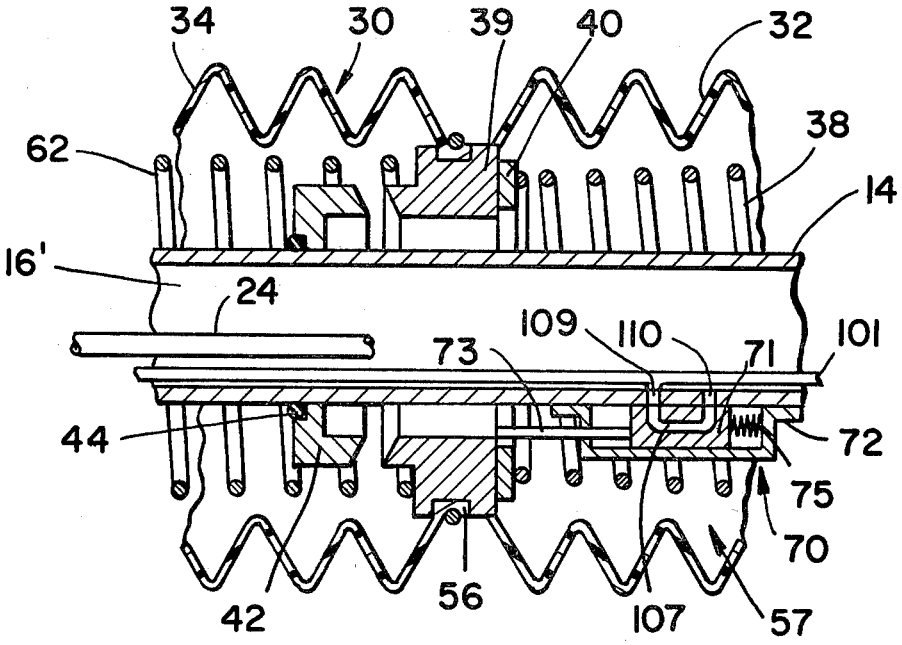
FIG. 3A is an enlarged fragmentary view of FIG. 1 illustrating in greater detail the vapor-seal valve, shown in an open position, and the fuel dumping means.
Figure 3B:
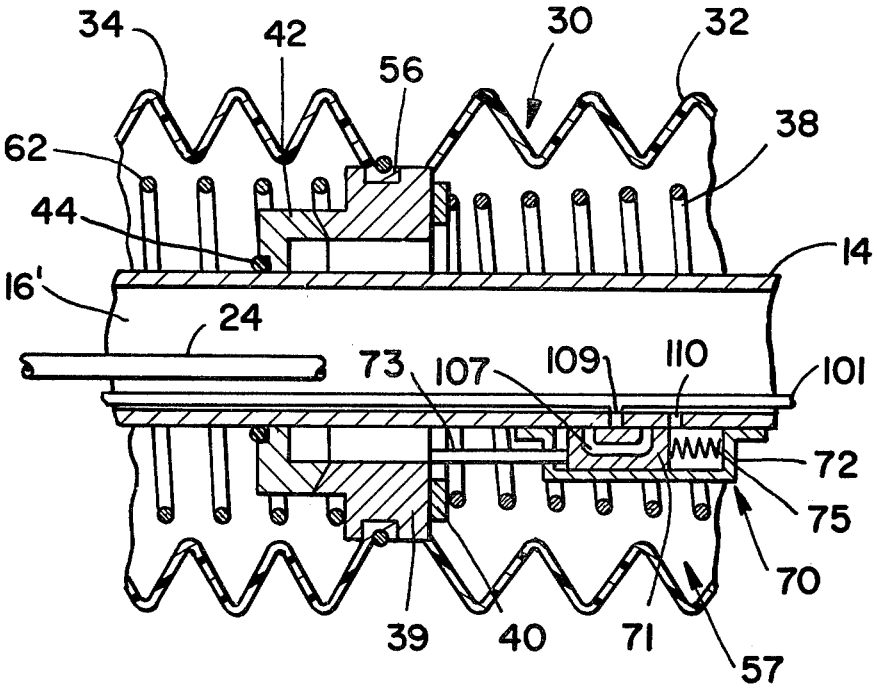
FIG. 3B is a view illustrating the vapor-seal valve of FIG. 3A in a closed position.

Referring to FIGS. 1, 3A and 3B, the vapor-recovery system for the nozzle 10 includes a vapor-recovery shroud, indicated generally by numeral 30, which consists of an inner portion 32 and an outer portion 34. The inner portion 32 of the shroud, which is formed with a plurality of circumferentially extending corrugations such that it is readily extended or retracted as required in use, has an upper end located in a channel 36 formed in the main body portion 12. An annular sealing closure means or collar 39 is formed as an integral portion of the outer end of the inner portion 32 of the shroud. A first compression spring 38, which serves to urge inner portion 32 to its extended position, has an inner end bearing against the main body portion 12 and its outer end bearing against an annular spacer ring 40 which is located on the inner face of sealing collar 39. An annular sealing seat 42 is mounted on the discharge spout 14 and extends radially outwardly therefrom. O-rings 44 serve to secure the sealing seat 42 with respect to the discharge spout 14. The sealing collar 39 sealingly engages the sealing seat 42 when the inner portion 32 of the shroud is in an extended position, see FIG. 3B. The first spring 38 is designed to apply a sealing pressure to the sealing collar 39 when it is in engagement with the sealing seat 42. The sealing relationship between the seat 42 and the collar 39 is such that when the inner portion 32 of the shroud is fully extended and a seal is made between the seat 42 and the collar 39 recovered vapors which are located within the nozzle cannot escape into the atmosphere through the open end of the shroud.

The outer portions 34 of the shroud has its inner end mounted in an annular recess 56 formed at the outer end of the inner portion 32. The outer portion 34 of the shroud has a soft annular sealing collar 58 at the outer end thereof. A backing plate 60 located at the inner face of the collar 58. A second extension spring 62 has one end bearing against collar 39 of the inner portion 32 of the shroud and its outer end bearing against a support ring 64. A pair of support arms, not illustrated, project forwardly from support ring 64 on opposite sides of the discharge spout 14 and into shallow recesses in plate 60 so that plate 60 and collar 58 are free to rock about the ends of the support arms to be aligned with the end of the fill pipe when the nozzle discharge spout is inserted in the fill pipe opening when in use. When the nozzle is operatively inserted in the fill pipe to a sufficient extent to displace the shroud 30 rearwardly to a retracted position, collar 39 is moved rearwardly away from seat 42 and the second spring 62 yields to serve to align the collar 58 with the end of the fill pipe. With collar 58 sealingly engaging the fill pipe and with collar 39 moved away from seat 42 so as to be in a non-sealing relationship therewith, vapors displaced from the fuel tank during refueling will be carried back into a vapor-recovery passage, indicated generally by reference numeral 57, which extends through shroud 30 and through the nozzle main body portion 12 and into a vapor recovery line 74, which is connected to the vapor-recovery passage in the nozzle main body portion.

From the foregoing, it is noted that seat member 42 and sealing collar 39 operate as a vapor-seal valve for the vapor-recovery system of nozzle 10. When the nozzle is not in use, shroud 30 is in its extended position, and the vapor-seal valve is closed in that the collar 39 sealingly engages seat 42 so that recovered vapors in the nozzle cannot escape through the open end of the shroud. When the nozzle discharge spout is operatively inserted into the fill pipe during refueling operations, the shroud 30 is moved rearwardly to its retracted position, and the vapor-seal valve is open in that collar 39 is moved rearwardly away from seat 42 to permit vapors recovered from the fuel tank during refueling to be carried back into vapor-recovery passage 57.

It would be apparent to those skilled in the art to incorporate the system of the present invention into nozzle vapor-recovery systems different from the one described above. Also, the vapor-recovery system described above could be modified in various ways, for example, shroud 30 could be modified to be formed as an integral unit rather than as one having an inner and an outer portion.

As discussed, when the nozzle is shut off after refueling, some fuel usually remains in the flow passage 16' in the discharge spout. This fuel may either spill from the discharge spout when the nozzle is being handled or evaporate in the discharge spout when the nozzle is stored in the fuel dispenser when not in use. In either case, such fuel spillage will produce hydrocarbon emissions, offsetting the gain made towards the control of vapor emissions by use of vapor-recovery nozzles. In accordance with an embodiment of the present invention, a pinch valve, generally indicated by reference numeral 90, as illustrated in FIGS. 1, 2A and 2B, is provided for sealing the outlet end 82 of the discharge spout 14 to prevent the flow of fuel and vapor out of the discharge spout and into the atmosphere when the nozzle is shut off. The pinch valve 90 is located in the discharge spout 14 at the outlet end 82 thereof where it is secured by any appropriate means, such as retainer rings 93. The outer end of pinch valve 90 is located inwardly of the outlet end 82 so that it will not be subjected to damage when the nozzle is being used. The inner end of pinch valve 90 is located outwardly of port 50 so that it will not interfere with the operation of the vacuum-operated release mechanism.

As is known in the art, the pinch valve may generally consist of a resilient sleeve 91, as shown in FIGS. 2A and 2B, arranged within a valve housing 92, which as mentioned above may be secured in the discharge spout by retainer rings 93, such that there is an annular space formed between the valve housing 92 and the resilient sleeve 91. A pinch valve is designed to open and close by the action of air or hydraulic pressure acting on the resilient sleeve wherein the pressure is applied to the annular space between the sleeve and the housing. In the present invention, pinch valve 90 is preferably operated by the fuel pressure available in the nozzle. When pinch valve 90 is closed, as shown in FIG. 2A, the surfaces of sleeve 91 on opposite sides of the valve sealingly engage one another to provide a fuel- and vapor-tight seal which prevents the escape of fuel and fuel vapors from the discharge spout when the nozzle is not in use. Accordingly, the resilient sleeve should be fabricated from a material, such as buna-n, that is resistant to deterioration, shrinkage and swell when exposed to fuel and fuel vapors. The valve housing 92 may also be made from buna-n or from some other material such as aluminum that is resistant to the deleterious effects of fuel and fuel vapors.

As discussed hereinabove, flow passage 16 is connected by means of fuel hose 72 to the fuel dispenser which supplies fuel to the nozzle at a fluid pressure of approximately 30 psi; therefore, a fuel pressure of approximately 30 psi is available to actuate pinch valve 90. To this purpose, a fluid passageway 101 is provided to establish fluid communication between pinch valve 90 and flow passage 16 upstream of flow control valve 20. Fluid passageway 101 extends from a port 102 in flow passage 16 upstream of the flow control valve through the nozzle main body portion and the discharge spout to pinch valve 90. In this manner, pinch valve 90 is in fluid communication with flow passage 16 upstream of flow control valve 20 so that fuel flows from flow passage 16 to pinch valve 90 at a fluid pressure of approximately 30 psi, providing the necessary fluid pressure to close the pinch valve. That portion of fluid passageway 101 extending through the nozzle main body portion 12 can either be cast or machined in the main body portion during fabrication of the nozzle. That part of fluid passageway 101 extending through the discharge spout may be cast as part of the discharge spout, or it may be a fluid conduit that extends through or along the outer surfaces of the discharge spout.

To open pinch valve 90, when the nozzle is being operated, a piston-cylinder assembly or fuel dumping means, indicated generally by numeral 70, is provided. Assembly 70, see FIGS. 3A and 3B, includes a piston 71 longitudinally movable within a cylinder 72 wherein cylinder 72 is located on discharge spout 14 so that one wall of cylinder 72 is actually formed from part of the outer surface of the discharge spout. Piston 71 has a piston rod 73 affixed to collar 39 of the vapor-seal valve so that piston 71 is responsive to the movement of collar 39. Piston 71 further includes a generally U-shaped fluid channel 107 formed therein for establishing fluid communication between fluid passageway 101 and flow passage 16' in the discharge spout. For this purpose, there is provided a port 109 which extends through the wall of discharge spout 14 to allow one end of channel 107 to be in fluid communication with fluid passageway 101. A second port 110 also extends through the wall of the discharge spout to allow the other end of channel 107 to be in fluid communication with flow passage 16'. Ports 109 and 110 are spaced a sufficient distance apart from one another so that they may be aligned with opposite ends of channel 107 in piston 71, see FIG. 3A, to establish fluid communication between pinch valve 90 and flow passage 16'. A spring means 75 is connected between an interior wall of cylinder 72 and that end of piston 71 to which piston rod 73 is not affixed. The spring means serves to normally urge piston 71 to a position wherein channel 107 is not in alignment, see FIG. 3B, with ports 109 and 110. When collar 39 sealingly engages seat 42, channel 107 is in this position of non-alignment so that piston 71 blocks port 109 to prevent the flow of fuel out of passageway 101 and into channel 107. When collar 39 is moved rearwardly from seat 42, spring means 75 permits piston 71 to move rearwardly a sufficient distance so that channel 107 is in a position of alignment with respect to ports 109 and 110. In this position, fluid communication is established between ports 109 and 110, and thus between pinch valve 90 and flow passage 16', so that fuel in pinch valve 90 and fluid passageway 101 flows into flow passage 16'.

In operation of the present invention, when the nozzle is not in use, the shroud 30, as discussed above, is in its extended position with collar 39 of the vapor-seal valve sealingly engaging seat 42 so that the vapor-seal valve is closed. When the vapor-seal valve is closed, channel 107 in piston 71 is urged by spring means 75 to a position of non-alignment, see FIG. 3B, with respect to ports 109 and 110 so that port 109 is blocked. When piston 71 is in this position, fuel will flow from flow passage 16 upstream of flow control valve 20, see FIG. 1, through port 102 and fluid passageway 101 to the annular space between pinch valve sleeve 91 and pinch valve housing 92, supplying a fluid pressure of approximately 30 psi to the annular space which causes sleeve 91 to inflate and thus close pinch valve 90. When the discharge spout is operatively inserted into the fuel tank fill pipe, shroud 30, as discussed above, is moved to its retracted position with collar 39 moving rearwardly with respect to seat 42 to open the vapor-seal valve. Since piston 71 is attached to collar 39 by means of piston rod 73, it is responsive to the movement of collar 39 so that as collar 39 moves rearwardly, piston 71 moves in a like direction within cylinder 72. When the vapor-seal valve is in an open position, channel 107 in piston 71 is in a position, see FIG. 3A, wherein one of its ends is in alignment with port 109 with its other end being in alignment with port 110. When channel 107 of piston 71 moves into this position, in response to the insertion of the discharge spout into the fill pipe, fluid communication is established between pinch valve 90 and flow passage 16', which causes pinch valve 90 to open. To explain more fully, the pressure in flow passage 16' is at approximately atmospheric pressure and the fuel supplied to pinch valve 90 flows at a pressure of approximately 30 psi; therefore, when channel 107 is in a position of alignment with respect to ports 109 and 110, a pressure differential is established across channel 107 which causes fuel to flow from pinch valve 90 through fluid passageway 101 and channel 107 into flow passage 16' where it flows through the outlet end of the discharge spout. It should be noted that it would be possible to size port 102 so that it has an opening that is sufficiently small so that when flow control valve 20 is open, very little fuel will flow into fluid passageway 101. Of course, any fuel that should flow through port 102 when channel 107 is aligned with ports 109 and 110 will flow through passageway 101 and channel 107 to flow passage 16'.

From the above description of the invention, it can be seen that when the nozzle is not in operation and shroud 30 is in its extended position with the vapor-seal valve closed, pinch valve 90 is closed to seal the outlet end of the discharge spout to prevent the flow of fuel and fuel vapors therethrough. On the other hand, when the discharge spout is operatively inserted into the fill pipe and the shroud is in its retracted position with the vapor-seal valve open, pinch valve 90 is open to provide an unrestricted flow passage for the flow of fuel out of the outlet end of the discharge spout.

Figure 4A:
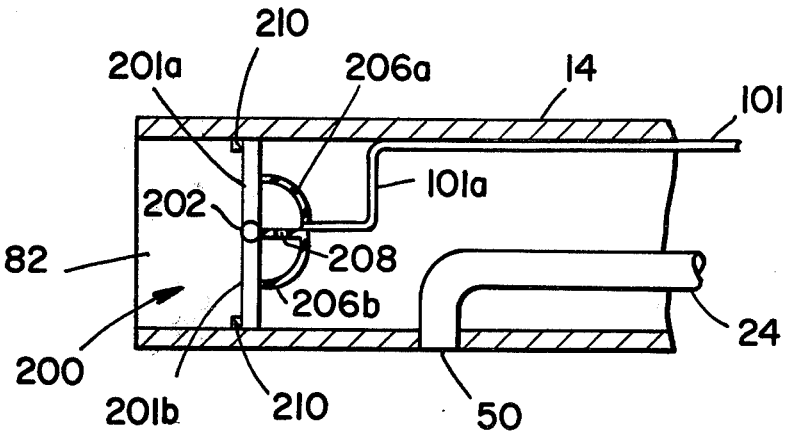
FIG. 4A is an enlarged fragmentary view of the outlet end of a discharge spout of a fuel dispensing nozzle illustrating another embodiment of the present invention wherein a wafer valve, shown in a closed position, is provided for sealing the outlet end of the discharge spout.
Figure 4B:
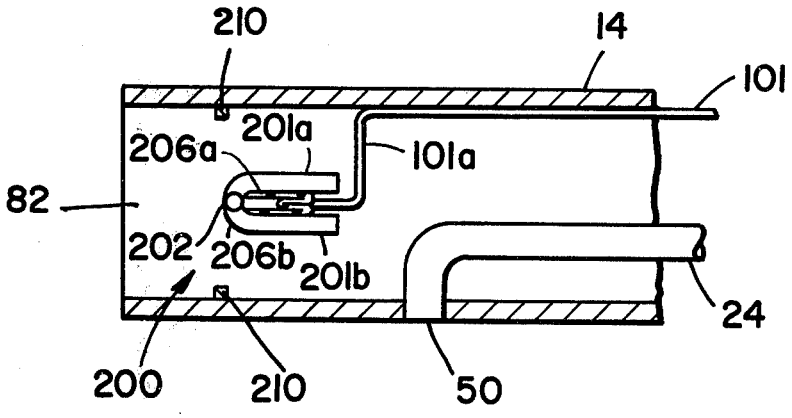
FIG. 4B is a view illustrating the wafer valve of FIG. 4A in an open position.

With reference to FIGS. 4A and 4B, another embodiment of the present invention, a wafer valve, indicated by reference numeral 200, is shown. Wafer valve 200 essentially consists of two substantially semi-circular discs **201*a* and 201*b* pivotally arranged around a shaft 202 which extends from one side of the discharge spout to the other side to support the discs therein. When wafer valve 200 is closed, as illustrated in FIG. 4A, discs 201*a* and 201*b* sealingly engage the inner surface of a valve seat 210, which is circumferentially arranged along the inner surface of the discharge spout to provide a fuel- and vapor-tight seal that seals the outlet end 82 of the discharge spout to prevent the escape of fuel and fuel vapors therethrough. The discs are also sealingly joined to shaft 202 in a manner that provides a fuel- and vapor-tight seal between shaft 202 and the discs. As is known in the art, the discs are joined to shaft 202** to pivot thereabout through 90° of movement from a vertical position when closed, see FIG. 4A, to a horizontal position when open, see FIG. 4B. As with the pinch valve sleeve and housing, the discs should be fabricated from a material, such as buna-n or aluminum, that is resistant to the deleterious effects of fuel and fuel vapors.

Wafer valve 200, like pinch valve 90, is operated to be in closed position when the vapor-seal valve is closed and to be in an open position when the vapor-seal valve is open. In this respect, the actuating system for wafer valve 200 is the same as that used with pinch valve 90 except that fluid passageway 101 has an extension **101*a* which extends into flow passage 16' to a point between discs 201*a* and 201*b* to establish fluid communication with a pair of inflatable balloon-like members 206*a* and 206*b*. Members 206*a* and 206*b* are in fluid communication with each other by means of a port 208 and are affixed to the backs of discs 201*a* and 201*b*, respectively. When the vapor-seal valve is closed and thus channel 107 of piston 71 is in a position of non-alignment with respect to ports 109 and 110, fuel at a pressure of approximately 30 psi will be supplied to members 206*a* and 206*b* through fluid passageways 101 and 101*a*, filling members 206*a* and 206*b* with fuel causing them to inflate to close wafer valve 200 as discs 201*a* and 201*b* sealingly engage valve seat 210. When the nozzle spout is operatively inserted in the fill pipe, the vapor-seal valve is open, and as discussed heretofore, channel 107 of piston 71 is in a position of alignment with respect to ports 109 and 110. When channel 107 is in this position, fuel flows out of members 206*a* and 206*b* and through fluid passageways 101*a* and 101 and channel 107 into flow passage 16', causing members 206*a* and 206*b* to deflate and open wafer valve 200** so that fuel may flow through the outlet end of the discharge spout.

It should also be noted that the wafer valve of the present invention could possibly be actuated by some type of mechanical system, as opposed to the above-described fuel-actuation system, wherein a mechanical linkage interconnects the wafer valve and the vapor-seal valve. It would also be possible to use in place of the wafer valve and pinch valve some other type of valve, such as an iris, butterfly or flapper valve; these alternate valves could then be either actuated by a fuel-actuation or mechanical system.

SUMMARY OF THE ADVANTAGES

The valve means of the present invention offers a relatively simple and economic means for eliminating the flow of fuel and fuel vapor through the outlet end of a nozzle discharge spout when the nozzle is not in operation, thereby preventing hydrocarbon emissions associated with such fuel spillage.

Although certain specific embodiments of the invention have been described in detail, the invention is not to be limited to only such embodiments but rather by the appended claims.

What is claimed is:

1. A vapor-recovery fuel dispensing nozzle, comprising:

a nozzle main body portion;

a discharge spout projecting from the main body portion, said discharge spout having an outlet end proportioned for ease of insertion into a fill pipe of a fuel tank;

a flow passage extending through said discharge spout and the nozzle main body portion for the flow of fuel therethrough;

a flow control valve in the nozzle main body portion operable to regulate the flow of fuel through said flow passage;

a vapor recovery passage means formed in the main body portion;

a vapor recovery shroud disposed radially outwardly from said discharge spout and having an inner end and an outer end, the inner end of said shroud connected to the nozzle main body portion in communication with said vapor recovery passage means;

a sealing collar at the outer end of said shroud for engagement with the fill pipe opening when said discharge spout is inserted therein in use of said nozzle to direct vapor expelled from the fuel tank during refueling to said vapor recovery passage means by way of said shroud;

a vapor-seal valve for said nozzle operable to be in a closed position to prevent the escape of vapors through the outer end of said shroud when said nozzle is not in use and to be in an open position when said discharge spout is inserted into the fill pipe in use of said nozzle so that vapor expelled from the fuel tank during refueling may be directed by way of said shroud to said vapor recovery passage means;

valve means responsive to the operation of said vapor-seal valve located in said discharge spout at the outlet end thereof for sealing the outlet end of said discharge spout to prevent the flow of fuel therethrough when said vapor-seal valve is in a closed position and for opening the outlet end of said discharge spout to permit the flow of fuel therethrough when said vapor-seal valve is in an open position; and means in communication with said vapor-seal valve and said valve means for closing said valve means to prevent the flow of fuel through the outlet end of said discharge spout when said vapor-seal valve is in a closed position and for opening said valve means to permit the flow of fuel through the outlet end of said discharge spout when said vapor-seal is in an open position.

2. A vapor-recovery fuel dispensing nozzle, comprising:

a nozzle main body portion;

a discharge spout projecting from the main body portion, said discharge spout having an outlet end porportioned for ease of insertion into a fill pipe of a fuel tank;

a flow passage extending through said discharge spout and the nozzle main body portion for the flow of fuel therethrough;

a flow control valve in the nozzle main body portion operable to regulate the flow of fuel through said flow passage;

a vapor recovery passage means formed in the nozzle main body portion;

a vapor recovery shroud having an inner end and an outer end, the inner end of said shroud connected to the nozzle main body portion to be in communication with said vapor recovery passage means, said shroud being disposed radially outwardly from said discharge spout and being movable between an extended position and a retracted position with respect to the nozzle main body portion, said shroud being in the retracted position when said discharge spout is inserted into the fill pipe when said nozzle is in use and in the extended position when said nozzle is not in use;

a sealing collar located at the outer end of said shroud for engagement with the fill pipe opening when said discharge spout is inserted therein during use of said nozzle to direct vapor expelled from the fuel tank during refueling to said vapor recovery passage means by way of said shroud;

a vapor-seal valve for said nozzle disposed within said shroud a substantial distance rearwardly of the outlet end of said discharge spout to be disposed outwardly from the fill pipe when said discharge spout is inserted therein, said vapor-seal valve operable to be in a closed position to prevent the escape of vapors through the outer end of said shroud when said shroud is in its extended position and to be in open position when said shroud is in its retracted position so that vapor expelled from the fuel tank during refueling may be directed through said shroud to said vapor recovery passage means;

valve means responsive to the operation of said vapor-seal valve and located in said discharge spout adjacent to the outlet end thereof for sealing the outlet end of said discharge spout to prevent the flow of fuel therethrough when said vapor-seal valve is in a closed position and for opening the outlet end of said discharge spout to permit the flow of fuel therethrough when said vapor-seal valve is in an open position;

a first means for closing said valve means to prevent the flow of fuel through the outlet end of said discharge spout when said vapor-seal valve is in a closed position; and a second means connected between said vapor-seal valve and said valve means for opening said valve means to permit the flow of fuel through the outlet end of said discharge spout when said vapor-seal valve is in an open position, said second means permitting said first means to close said valve means to prevent the flow of fuel through the outlet end of said discharge spout when said vapor-seal valve is in a closed position.

3. A vapor-recovery fuel dispensing nozzle, comprising:

a nozzle main body portion;

a discharge spout projecting from the nozzle main body portion, said discharge spout having an outlet end proportional for ease of insertion into a fill pipe of a fuel tank;

a flow passage extending through said discharge spout and the nozzle main body portion for the flow of fuel therethrough;

a flow control valve in the nozzle main body portion operable to regulate the flow of fuel through said flow passage;

a vapor recovery passage means formed in the main body portion;

a vapor recovery shroud having an inner end and an outer end, the inner end of said shroud connected to the nozzle main body portion to be in communication with said vapor recovery passage means, said shroud being disposed radially outwardly from said discharge spout and being movable between an extended position and a retracted position with respect to the nozzle main body portion, said shroud being in the retracted position when said discharge spout is inserted into the fill pipe when said nozzle is in use and said shroud being normally urged towards the extended position when said nozzle is not in use;

a sealing collar located at the outer end of said shroud for engagement with the fill pipe opening when said discharge spout is inserted therein during use of said nozzle to direct vapor expelled from the fuel tank during refueling to said vapor recovery passage means by way of said shroud;

sealing seat means located on said discharge spout rearwardly from the outlet end of said discharge spout to be disposed outwardly from the fill pipe opening when said discharge spout is inserted therein;

seal closure means disposed within said shroud and spaced a substantial distance rearwardly from the outer end of said shroud, said seal closure means sealingly engaging said sealing seat means when said shroud is in its extended position whereby vapor which is located inwardly thereof cannot escape from said shroud by way of the outer end thereof, said seal closure means being moved rearwardly away from said sealing seat means when said shroud is moved to its retracted position when said discharge spout is inserted into the fill pipe when said nozzle is in use whereby vapor expelled from the fuel tank during refueling may be directed through said shroud to said vapor recovery passage means;

valve means, operable by a fluid pressure, located in said discharge spout adjacent to the outlet end thereof for sealing the outlet end of said discharge spout to prevent the flow of fuel and vapors therethrough when said seal closure means sealingly engages said sealing seat means and for opening the outlet end of said discharge spout to permit flow of fuel therethrough when said seal closure means is moved rearwardly away from said sealing seat means when said discharge spout is inserted into the fill pipe when said nozzle is in use;

fuel supply means for providing a fluid pressure to said valve means so that said valve means is closed to seal the outlet end of said discharge spout when said seal closure means sealingly engages said sealing seat means; and fuel dumping means responsive to the movement of said seal closure means for removing the fluid pressure supplied to said valve means to open said valve means to permit the flow of fuel through the outlet end of said discharge spout when said seal closure means is moved rearwardly away from said sealing seat means when said discharge spout is inserted into the fill pipe when said nozzle is in use.

4. The fuel dispensing nozzle of claim 3 wherein said fuel supply means comprises a fluid passageway connecting said flow passage upstream of said flow control valve with said valve means for flowing fuel from said flow passage upstream of said flow control valve to said valve means in order that a fluid pressure is supplied to said valve means to close said valve means.

5. The fuel dispensing nozzle of claim 4 wherein said fuel dumping means comprises:

a cylinder disposed within said shroud and located on said discharge spout in proximate relation to said seal closure means, said cylinder having a first port in fluid communication with said fluid passageway connecting said flow passage upstream of said flow control valve with said valve means and a second port in fluid communication with said flow passage in said discharge spout;

a piston longitudinally movable within said cylinder said piston having a fluid channel means formed therein for establishing fluid communication between said first and said second ports in said cylinder;

a piston rod of said piston connected to said seal closure means so that said piston is responsive to the movement of said seal closure means to be movable within said cylinder so that said fluid channel means is movable between a position of alignment with respect to said first and said second ports in said cylinder to establish fluid communication therebetween and a position of non-alignment with respect to said first and said second ports in said cylinder, said fluid channel means being normally urged towards the position of non-alignment;

said fluid channel means being in a position of alignment when said seal closure means is moved rearwardly away from said sealing seat means so that fuel will flow out of said valve means, the fluid pressure supplied to said valve means being greater than the pressure in said flow passage in said discharge spout, through said fluid passageway connecting said flow passage upstream of said flow control valve with said valve means, said first port, said fluid channel means, and said second port and into the flow passage in said discharge spout, thereby removing the fluid pressure supplied to said valve means in order that said valve means opens; and said fluid channel means is in a position of non-alignment when said seal closure means sealingly engages said sealing seat means so that fuel flows through said fluid passageway connecting said flow passage upstream of said flow control valve with said valve means in order that a fluid pressure is supplied to said valve means to close said valve means.

6. The fuel dispensing nozzle of claim 5 wherein said valve means is a pinch valve.

7. The fuel dispensing nozzle of claim 5 wherein said valve means comprises a wafer valve operable by a pair of inflatable members in fluid communication with each other so that when a fluid pressure is supplied to said pair of inflatable members said wafer valve closes to seal the outlet end of said discharge spout and so that when the fluid pressure is removed from said pair of inflatable members said wafer valve opens to permit the flow of fuel through the outlet end of said discharge spout.

8. A method for preventing fuel spillage from a discharge spout of a vapor-recovery fuel dispensing nozzle, the nozzle including a main body portion, the discharge spout projecting from the main body portion and having an outlet end proportional for ease of insertion into a fill pipe of a fuel tank, a flow passage extending through the discharge spout and the nozzle main body portion, a flow control valve in the nozzle main body portion to regulate the flow of fuel therethrough, a vapor recovery passage means formed in the main body portion, a vapor recovery shroud disposed radially outwardly from the discharge spout and having an inner end and an outer end, the inner end of said shroud connected to the main body portion in communication with said vapor recovery passage means, a sealing collar at the outer end of said shroud for engagement with the fill pipe opening when the discharge spout is inserted therein in use of said nozzle to direct vapor expelled from the fuel tank during refueling to said vapor recovery passage means by way of said shroud, a vapor-seal valve for said nozzle operable to be in a closed position to prevent the escape of vapors through the outer end of said shroud when said nozzle is not in use and to be in an open position when the discharge spout is inserted into the fill pipe in use of said nozzle so that vapor expelled from the fuel tank during refueling may be directed by way of said shroud to said vapor recovery passage means, comprising:

locating a valve means responsive to the operation of said vapor-seal valve in the discharge spout adjacent to the outlet end thereof for sealing the outlet end of the discharge spout to prevent the flow of fuel therethrough when said vapor-seal valve is in a closed position and for opening the outlet end of the discharge spout to permit the flow of fuel therethrough when said vapor-seal valve is in an open position; and providing means in communication with said vapor-seal valve and said valve means for closing said valve means to prevent the flow of fuel through the outlet end of the discharge spout when said vapor-seal valve is in a closed position and for opening said valve means to permit the flow of fuel through the outlet end of the discharge spout when said vapor-seal valve is in an open position.

* * * * *